United States Patent [19]

Nilsen et al.

[11] Patent Number: 4,649,237

[45] Date of Patent: Mar. 10, 1987

[54] POWER LINE/TRANSFORMER SWITCH

[75] Inventors: Gunnar Nilsen, Harestua; Erik Wang, Blommenholm; Ingar Moen, Porsgrunn, all of Norway

[73] Assignee: A/S Norsk Elektrisk & Brown Boveri, Oslo, Norway

[21] Appl. No.: 711,896

[22] Filed: Mar. 14, 1985

[30] Foreign Application Priority Data

Mar. 15, 1984 [NO] Norway ..... 841013

[51] Int. Cl.[4] ..... H01H 21/54; H01H 31/00

[52] U.S. Cl. ..... 200/15; 200/48 KB

[58] Field of Search ..... 200/48, 15, 254, 162, 200/145; 174/137 B, 209

[56] References Cited

U.S. PATENT DOCUMENTS

| | | | |
|---|---|---|---|
| 1,731,775 | 10/1929 | Heinrich | 200/48 R X |
| 1,907,141 | 5/1933 | Bowie | 200/15 X |
| 2,009,815 | 7/1935 | Powers | 200/48 R |
| 3,475,546 | 10/1969 | Sadler | 174/137 B |
| 3,632,935 | 1/1972 | Stegmaier | 200/254 |
| 3,751,611 | 8/1973 | Kerr, Jr. | 200/48 R |
| 3,898,372 | 8/1975 | Kalb | 174/137 B X |
| 4,246,696 | 1/1981 | Bauer et al. | 174/209 |
| 4,302,646 | 11/1981 | Osborne et al. | 200/48 KB X |

*Primary Examiner*—J. R. Scott

*Attorney, Agent, or Firm*—Pollock, Vande Sande & Priddy

[57] ABSTRACT

A power line/transformer switch of the isolator type, with knife members for the respective phases disposed on a common, rotatable shaft of insulating material. The respective contacts for the knives are disposed on an opposing, fixed shaft composed of insulating material. The respective shafts are mounted at one end of supports that are joined at the opposite end such that the supports constitute the legs of a V-shaped frame. The base of the V-formed supports is disposed perpendicularly on the longitudinal support bar that is parallel with the shafts, this longitudinal bar being provided with fasteners for attachment to a tower.

5 Claims, 4 Drawing Figures

POWER LINE/TRANSFORMER SWITCH

BACKGROUND OF THE INVENTION

The present invention relates to an overhead power line/ transformer switch of the isolator type having knife-blades for the respective phases, Switches on the market today for use on overhead power lines are usually based on the use of porcelain insulators (pin- type insulators or massive porcelain insulators). These are normally disposed at a 90° angle on a shaft. The switch is normally used as an isolating switch, or a contact (sweep) is provided in addition for switching unloaded lines or unloaded transformers. A load head can also be mounted for switching load currents.

This type of equipment either has limited applicability, or it is expensive, because the switch is cumbersome to operate and the contact system is not independent of the reaction time of the switch.

In recent years, remote control of overhead power line networks has become more common. Automatic sectional switches have also been installed in the network for reducing the interruption intervals, which can be lengthy if only one centrally disposed power switch is provided per line. This places demands on the switch, which should be operable by means of a relatively inexpensive motorized drive means and mechanisms for connecting and switching loads.

BRIEF DESCRIPTION OF THE INVENTION

This is provided according to the invention with an isolating switch of the general type defined above, which is characterized in that the respective contacts for the knives of the switch are disposed on an opposing fixed shaft composed of insulation material.

The advantage of this system is that the moment of rotation is reduced because the center of rotation is located in closer proximity to the center of the shaft. This permits the use of simple rotary means or motor drive means.

The device is also a simpler and lighter weight construction, and it is therefore easier to install on the towers or supports for the power lines.

Another advantage of this switch is that it can be disposed independently of direction. Pin-type insulators, for example, cannot be placed upside-down.

BRIEF DESCRIPTION OF THE DRAWINGS

The invention will be described in greater detail in the following with reference to the accompanying drawings, wherein.

DESCRIPTION OF THE PREFERRED EMBODIMENT

Figure 1:
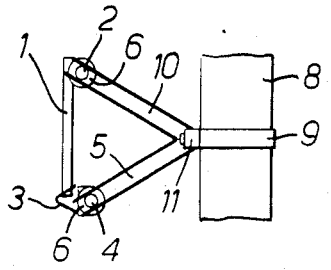
FIG. 1 shows the switch in cross section.
Figure 2:
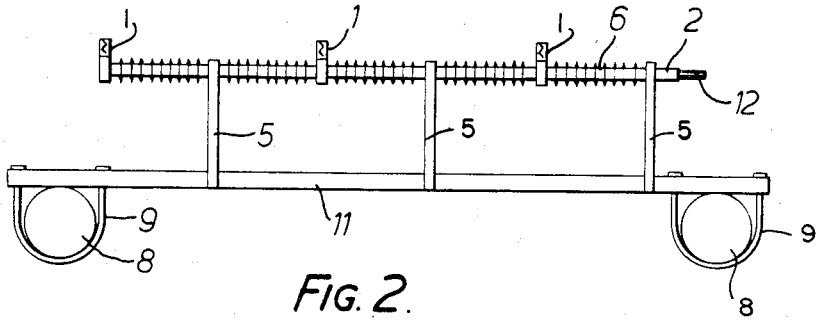
FIG. 2 shows the switch in side view.
Figure 3:
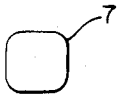
FIG. 3 shows an exemplary cross-sectional configuration of the shaft of the switch.
Figure 4:
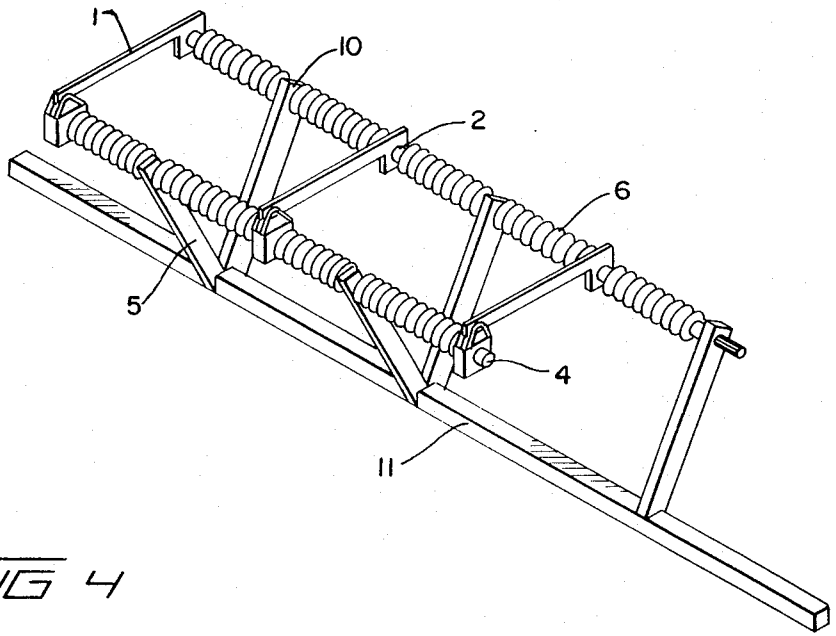
FIG. 4 shows a top perspective view of the switch.

The switch consists of knives 1 clamped to a rotatable shaft 2, the shaft being made of insulating material such as fiberglass-reinforced polyester, for example. The shaft 2 may have a cross-sectional configuration as shown in FIG. 3.

The knives 1 cooperate with opposing contacts 3 disposed on a shaft 4 corresponding to the shaft 2.

On the shaft 2 and 4 between the respective knives 1 and contacts 3, shrink-fitted insulator jackets 6 made of weather resistant plastic or rubber material are provided as a safeguard against leaking current.

The shafts 2 and 4 are mounted on the ends of supports 5 and 10 which are joined at the opposite ends thereof so that they form a "V", and the base or point of the V is fixedly attached to a longitudinal support bar 11 which is parallel with the shafts 2 and 4. The longitudinal support bar 11 is provided with fastening means 9 for attachment to the power line tower 8.

The knives 1 are guided into positions of connection or disconnection with the contacts by rotating the shaft 2 by means of a manual actuator provided at the end 12 of the shaft 2 or by means of a suitable motor drive means connected thereto.

Having described our invention, we claim:

1. An overhead powerline/transformer switch of the isolater type comprising;

a first rotatable shaft member, being made of an insulating material;

a plurality of knife members for the respective phases disposed on said first shaft member;

a second fixed shaft member, made of an insulating material;

a plurality of contact members corresponding to said knife members, said contact members being disposed on said second shaft member for engaging said knife members;

a plurality of shrink-fitted insulator jackets mounted on said first shaft between said knife members and on said second shaft between said contact members for preventing current leakage; and a V-shaped frame consisting of two integrally joined legs or supports at the apex of the V and said first and second shafts mounted at the other end of the legs or supports.

2. A switch according to claim 1 wherein said first and second shaft members are fiberglass-reinforced polyester mater- ial.

3. A switch according to claim 1 wherein said insulator jackets comprise a weather-resistant plastic or rubber material.

4. A switch according to claim 1 wherein said first shaft further comprises at its one end means for connecting manual or motorized rotation means for moving said knife blade members to contact or disconnect said corresponding contact members.

5. A switch according to claim 1 further comprising a longitudinal support bar member, said integrally-joined legs of said V-shaped frame being fixed to said bar and aligned parallel to each other, said bar member having fastening means for attachment to a tower.

* * * * *